United States Patent [19]

Metzger

[11] 4,246,514

[45] Jan. 20, 1981

[54] ENERGY-SAVING ELECTRONIC STROBE FLASH APPARATUS HAVING DUAL FLASHTUBES

[75] Inventor: Lenard M. Metzger, Rochester, N.Y.

[73] Assignee: Eastman Kodak Company, Rochester, N.Y.

[21] Appl. No.: 87,189

[22] Filed: Oct. 22, 1979

[51] Int. Cl.³ ..... H05B 41/34

[52] U.S. Cl. ..... 315/241 P; 315/200 A; 315/323; 315/324; 315/232

[58] Field of Search ..... 315/200 A, 232, 241 R, 315/241 P, 241 S, 312, 323, 324; 354/132; 340/331

[56] References Cited

U.S. PATENT DOCUMENTS

| | | | |
|---|---|---|---|
| 3,438,766 | 4/1969 | Biber | 315/241 P X |
| 4,139,805 | 2/1979 | Cosco et al. | 315/241 R |

FOREIGN PATENT DOCUMENTS

| | | | |
|---|---|---|---|
| 1292136 | 3/1969 | Fed. Rep. of Germany | 315/241 R |
| 912982 | 12/1962 | United Kingdom | 315/241 P |

*Primary Examiner*—Eugene R. La Roche

*Attorney, Agent, or Firm*—D. P. Monteith

[57] ABSTRACT

Electronic strobe flash apparatus has first and second flashtubes which are fired alternately and repeatedly to produce a composite, extended light flash. A start pulse triggers the first flashtube to cause a first normally charged capacitor to discharge through a primary winding of a transformer, the first flashtube, and a second normally discharged capacitor, thereby firing the first flashtube and charging the second capacitor. The transformer is adapted to produce a flashtube trigger voltage across its secondary winding when current in its primary winding is interrupted. The second capacitor is smaller than the first capacitor so that the voltage across the second capacitor increases more rapidly than the decrease in voltage across the first capacitor during its discharge. When the difference between the voltages across the two capacitors decreases to a predetermined level, the current from the first capacitor is interrupted, which quenches the first flashtube and produces a voltage of a first polarity across the secondary winding that triggers the second flashtube. In response to triggering the second flashtube, the second capacitor discharges through the second flashtube and the primary winding, thereby firing the second flashtube. When the second capacitor is substantially discharged, current from the second capacitor is interrupted, which quenches the second flashtube and produces a voltage of a second polarity across the secondary winding that triggers the first flashtube. In response to triggering the first flashtube, the first capacitor discharges again, and the aforementioned operating cycle is repeated. A control switch, responsive to the occurrence of a predetermined exposure parameter, causes current from the second capacitor to bypass the primary winding to terminate the light pulses.

6 Claims, 3 Drawing Figures

ENERGY-SAVING ELECTRONIC STROBE FLASH APPARATUS HAVING DUAL FLASHTUBES

BACKGROUND OF THE INVENTION

1. Field of the Invention

This invention relates to energy-saving electronic strobe flash apparatus. More particularly, this invention relates to energy-saving electronic strobe flash apparatus which fires dual flashtubes alternately and repeatedly to produce a composite light pulse.

2. Description of the Prior Art

Electronic strobe flash apparatus includes a chargeable capacitor that supplies a discharge current to a flashtube to produce a high intensity light pulse which lasts no longer than approximately one millisecond. Electronic strobe flash apparatus can include circuitry for quenching the flashtube to regulate its light output. In one arrangement, commonly referred to as "shunt quench," the circuitry causes the current from the firing capacitor to by-pass the flashtube to terminate its light output. Shunt-quench has a disadvantage because the energy stored on the capacitor that produces the current which bypasses the flashtube is wasted.

In a second arrangement, commonly referred to as "series-quench," the circuitry causes a switch in series with the flashtube to open to terminate the current from the capacitor, thereby quenching the flashtube. However, series-quench generally requires a relatively complicated commutating circuit to open the switch rapidly. Furthermore, the switch must be capable of handling a large current and voltage.

U.S. Pat. No. Re. 28,025 and U.S. Pat. No. 3,809,951 describe series-quench electronic strobe flash apparatus that use a commutating circuit to quench the flashtube.

However, it is desirable and expedient to use series-quench electronic strobe flash apparatus, particularly if the flash apparatus is used with an electronically-controlled camera that loads its battery heavily, and if the flash apparatus does not employ complicated commutating circuitry. U.S. Pat. No. 3,438,766 describes series-quench electronic strobe flash apparatus having dual flashtubes both of which are used as a light source and as a current-interrupting switch. A first firing circuit includes a large storage capacitor, one of the flashtubes, and a small receiver capacitor. A second firing circuit includes the receiver capacitor and the second flashtube. When the first flashtube is triggered, the storage capacitor discharges to fire the first flashtube and to charge the receiver capacitor. When the voltage on the receiver capacitor is approximately the voltage on the storage capacitor, the discharge current is interrupted, thereby quenching the first flashtube. When the second flashtube is triggered, the receiver capacitor discharges to fire it. The flashtubes are triggered alternately and repeatedly to produce a train of low intensity light pulses. After a predetermined time relating to the illumination requirements of a scene being photographed, the triggering of the flashtubes is terminated.

The flash apparatus described in U.S. Pat. No. 3,438,766 patent requires an external pulse generator for triggering the flashtubes. The generator is relatively complicated in its operation and construction, and would add significantly to the overall cost of the flash apparatus. Furthermore, the generator operates so that adjacent light pulses are separated in time such that the pulse duty factor of the pulse train is low. Flash illumination of this configuration is not ideally suitable to an application that requires exposing a fast-action scene.

U.S. Pat. No. 3,783,336 describes series-quench electronic strobe flash apparatus having a single flashtube that is supplied with firing current alternately from a pair of capacitors to produce flash illumination. A first firing circuit consists of a large storage capacitor, a first SCR, a receiver capacitor, and the flashtube. A second firing circuit consists of the receiver capacitor, the flashtube, and a second SCR. When a trigger circuit triggers the flashtube, the first SCR conducts, which causes the storage capacitor to discharge, thereby firing the flashtube and charging the receiver capacitor. When the receiver capacitor is charged to a given voltage, the first SCR turns OFF to interrupt current from the storage capacitor to the flashtube. In synchronism with the interruption of the storage capacitor current, the second SCR conducts, which causes the receiver capacitor to discharge to fire the flashtube. When the receiver capacitor is substantially discharged, the second SCR turns OFF to interrupt current from the receiver capacitor to the flashtube. In synchronism with the interruption of the receiver capacitor current, the first SCR conducts and the cycle repeats.

Because the flashtube is triggered only once for each exposure, a relatively complicated pulse control switching current is required for synchronously and repeatedly switching the 2 SCR's into conduction so that the flashtube gas is not deionized prematurely. Furthermore, the SCR's must be capable of handling high current, and they dissipate power which might otherwise be delivered to the flashtube to produce additional light.

SUMMARY OF THE INVENTION

In accordance with the present invention, electronic flash apparatus includes first and second energizable flashtubes having first and second electrodes, respectively, for triggering the flashtubes into conduction to produce light pulses, first and second capacitors for supplying firing currents to the respective flashtubes, for causing them to produce respective light pulses, and means for charging the first capacitor. A first firing circuit, which includes the first flashtube, and the first and second capacitors, has (1) a first state, occurring in response to triggering the first flashtube, for causing a first firing current to flow from the first capacitor through the first flashtube to produce a light pulse, and to charge the second capacitor, and (2) a second state, occuring in response to the charging of the second capacitor to a predetermined voltage, for interrupting the first firing current, thereby quenching the first flashtube. A second firing circuit, which includes the second flashtube and the second capacitor, responsive to triggering the second flashtube, causes a second firing current to flow from the second capacitor to fire the second flashtube. The flash apparatus further includes a circuit for applying a voltage to the first electrode for initially triggering the first flashtube, and current-sensitive means, coupling the first circuit to the second electrode, for triggering the second flashtube in response to the interruption of the first firing current, whereby the first and second flashtubes are fired sequentially to produce sequential light pulses.

In a preferred embodiment, the current-sensitive means is constituted by a transformer having a primary winding connected into both the first and second firing circuits, and a secondary winding adapted to produce a flashtube trigger voltage in response to interrupting current in the primary winding. First and second diodes couple the secondary winding to the first and second electrodes, respectively. The second diode conducts in response to a flashtube trigger voltage when the first firing current is interrupted to trigger the second flashtube, and the first diode conducts in response to a flashtube trigger voltage when the second firing current is interrupted to trigger the first flashtube, so that the first and second flashtubes are alternately and repeatedly fired to produce alternate light pulses repeatedly. A control switch, responsive to the occurrence of a predetermined exposure parameter, causes current to bypass the primary winding to prevent the production of a flashtube trigger voltage, whereby the light pulses are terminated.

The invention, and its advantages, will become more apparent in the detailed description of preferred embodiments presented below.

BRIEF DESCRIPTION OF THE DRAWING

The invention will be described with reference to the accompanying drawing, wherein.

DESCRIPTION OF THE PREFERRED EMBODIMENTS

Because electronic strobe flash apparatus is well known, the present description will be directed in particular to elements forming part of, or cooperating directly with, apparatus in accordance with the present invention. It is to be understood that elements not specifically shown or described may take various forms well known to those having skill in the photographic art.

Figure 1:
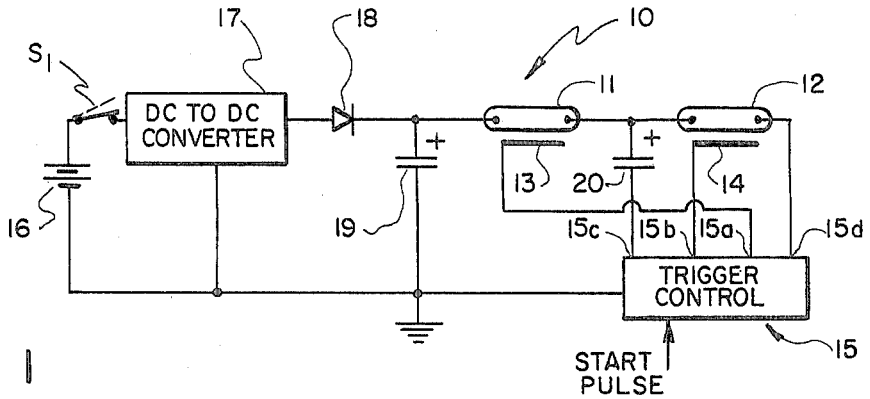
FIG. 1 illustrates, largely in block diagram form, self-oscillating electronic strobe flash apparatus having dual flashtubes, according to the present invention.

FIG. 1 illustrates generally energy-saving electronic strobe flash apparatus 10 according to the present invention. Apparatus 10 includes two flashtubes 11 and 12, which are connected, as shown. The flashtubes 11 and 12 have trigger electrodes 13 and 14, respectively, which are connected to outputs 15*a* and 15*b*, respectively, of a trigger control circuit 15.

A battery 16 energizes a conventional DC—DC converter 17 when a switch $S_1$ is closed. By means well known in the electronic flash art, the converter 17 produces a series of alternating voltage pulses. Each positive voltage pulse causes a diode 18 to conduct, which, in turn, causes a storage capacitor 19 to charge. For example, the converter 17 may charge the capacitor 19 to approximately 350 volts.

A metering capacitor 20 is connected between a terminal common to the two flashtubes 11 and 12 and an input 15*c* of the control circuit 15. A second input 15*d* of the circuit 15 is connected to the flashtube 12, as shown.

The circuit 15 is arranged to apply a voltage pulse to the electrode 14 to trigger the flashtube 12, when the flashtube 11 is quenched, and to apply a voltage pulse to the electrode 13 to trigger the flashtube 11, when the flashtube 12 is quenched.

In operation, a suitable START pulse causes the circuit 15 to apply an initial voltage pulse to the electrode 13. This initial pulse triggers the flashtube 12, which causes its impedance to decrease abruptly. When this happens, a firing current flows from the capacitor 19 through the flashtube 11 and the metering capacitor 20, into the trigger control circuit 15. This firing current causes the flashtube 11 to emit a high intensity light pulse and charges the capacitor 20. As the capacitor 20 charges, its voltage approaches the voltage on the storage capacitor 19, thereby decreasing the potential difference across the flashtube 11. When this potential difference decreases below a voltage that is necessary to sustain conduction of the flashtube 11, approximately 50 volts, firing current from the capacitor 19 is interrupted, thereby quenching the flashtube 11.

In response to the interruption of current through the flashtube 11, the circuit 15 applies a voltage pulse to the electrode 14, which triggers the flashtube 12. In response thereto, a firing current flows from the capacitor 20 through the flashtube 12, thereby producing a light pulse, into the trigger control circuit 15.

When the capacitor 20 discharges to approximately 50 volts, the firing current from the capacitor is interrupted, thereby quenching the flashtube 12. In response to the interruption of current through the flashtube 12, the circuit 15 applies a voltage pulse to the electrode 13 to trigger the flashtube 11, and the aforementioned operating cycle is repeated.

The metering capacitor 20 is selected to be small compared to the storage capacitor 19 so that the voltage across the metering capacitor increases more rapidly than the decrease in voltage across the storage capacitor during its discharge. The capacitor 20 can become charged to about 250 volts while the capacitor 19 discharges only slightly, approximately 10 volts, during each operating cycle of the flash apparatus 10.

The storage capacitor 19 both fires the flashtube 11 and charges the capacitor 20. As long as the voltage across the capacitor 19 is large enough to charge the capacitor 20 to a level that is necessary to fire the flashtube 12, the flashtubes 11 and 12 can be fired alternately and repeatedly. A composite light pulse is produced that is extended over an interval proportional to the number of times each flashtube is fired. The length of this interval can be sufficiently long to enable a conventional shutter in a camera (not shown) with which the flash unit 10 is used to regulate the amount of exposure light permitted to fall on the film unit.

The composite light pulse consists of a series of individual light pulses having generally uniform widths and gradually decreasing peak amplitudes. Adjacent light pulses are spaced so close in time the composite light pulse is effectively a single pulse, the intensity of which decays slowly with time.

Figure 2:
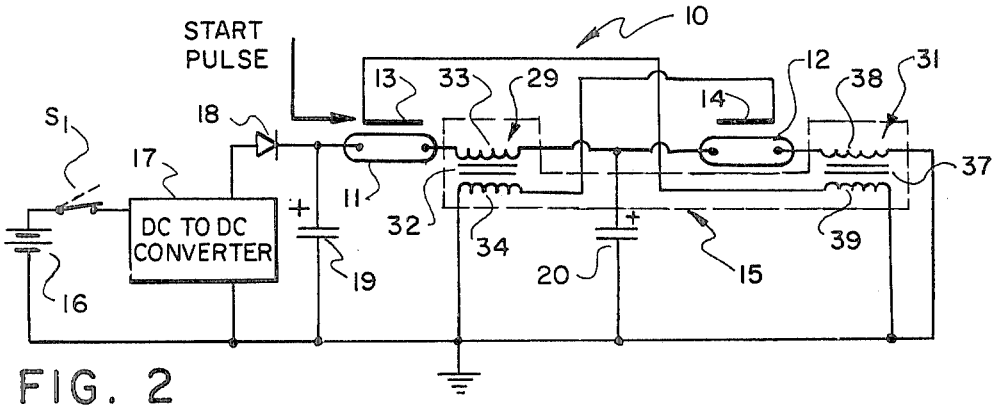
FIG. 2 illustrates a circuit diagram of a preferred embodiment for triggering the two flashtubes of FIG. 1 alternately and repeatedly.

FIG. 2 illustrates circuitry for triggering automatically the flashtubes 11 and 12 in response to interrupting firing current supplied to the two flashtubes. Apparatus shown in FIG. 2 that corresponds to and performs the same function as apparatus shown in FIG. 1 is identified by the same numeral.

The trigger control circuit 15 of FIG. 2 is constituted by a transformer 29 and a transformer 31. The transformer 29 has a core 32, and a primary winding 33, one terminal of which is connected to the flashtube 11 and the other terminal of which is connected to the terminal common to the capacitor 20 and the flashtube 12. A secondary winding 34 of the transformer 29 is in series between the trigger electrode 14 and ground.

The transformer 31 has a core 37, a primary winding 38 in series between the flashtube 12 and ground, and a secondary winding 39 connected between ground and the electrode 13.

The transformers 29 and 31 are arranged to produce a flashtube trigger voltage across the secondary windings 34 and 39, respectively, in response to the interruption of current through their respective primary windings 33 and 38.

Assume that a voltage pulse is applied to electrode 13 for initially triggering the flashtube 11. In response thereto, a firing current flows from the capacitor 19 through the flashtube 11, the primary winding 33 and the metering capacitor 20 to ground. This firing current causes the flashtube 11 to produce a light pulse, and charges the metering capacitor, as described above.

As firing current flows into the winding 33, a magnetic field builds in the core 32 that is directly proportional to the winding current. The energy stored in the core 32 equals $\frac{1}{2}$ $LI^2$ where L is the inductance of the winding 33 and I is the current.

When the capacitor 20 is charged so that the potential difference across the flashtube 11 is insufficient to sustain its conduction, the firing current from the capacitor 19 is interrupted, thereby quenching the flashtube 11.

When current through the winding 33 is interrupted, the magnetic field in the core 32 is no longer sustained, and collapses rapidly. Since voltages across a transformer's windings are equal to the number of turns in their respective windings times the rate of change of the transformer's magnetic field, large voltage pulses occur across the windings 33 and 34 as the magnetic field collapses. The voltage across the winding 34, in response to interrupting firing current in the winding 33, triggers the flashtube 12 into conduction.

In response to triggering the flashtube 12, the capacitor 20 discharges through the flashtube 12 and the winding 38 to ground, thereby causing the flashtube to produce a light pulse and a magnetic field to build in the transformer core 37.

When the voltage across the capacitor 20 decreases below a level that is necessary to sustain conduction of the flashtube 12, the firing current through the flashtube 12 and the winding 38 terminates abruptly. Similarly to the operation of the transformer 29, the magnetic field in the core 37 collapses rapidly. In response thereto, a large voltage pulse is induced across the winding 39 that triggers the flashtube 11 so that the aforementioned operating cycle of the apparatus 10 can be repeated.

Figure 3:
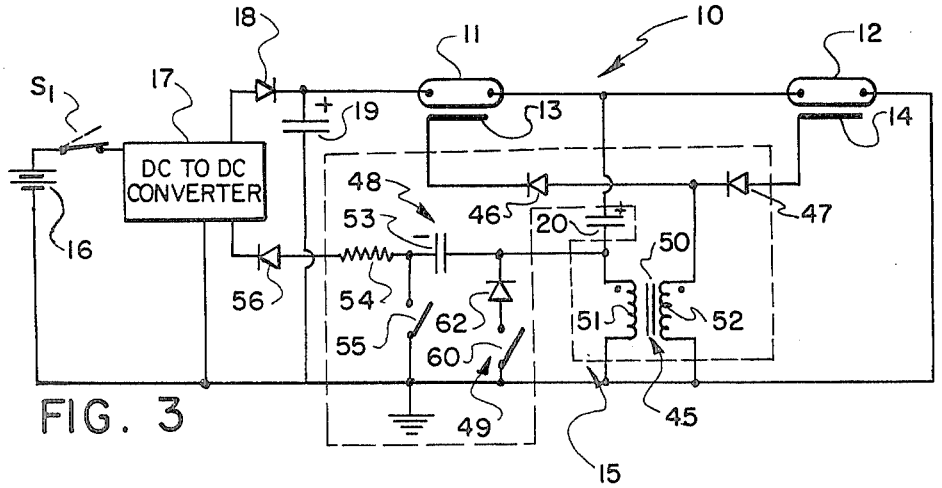
FIG. 3 illustrates an alternate preferred embodiment of electronic strobe flash apparatus of FIG. 1, and shows circuitry for starting and stopping energization of the flash apparatus, and circuitry for alternately and repeatedly triggering the two flashtubes.

FIG. 3 illustrates an alternate preferred embodiment of the present invention in which the trigger control circuit 15 includes a single transformer 45, and diodes 46 and 47 for alternately and repeatedly triggering the flashtubes 11 and 12. The circuit 15 of FIG. 3 also includes circuitry 48 for applying a voltage pulse to the electrode 13 for initially triggering the flashtube 11, and circuitry 49 for terminating the production of light pulses by the flashtubes 11 and 12.

The transformer 45 has a core 50, a primary winding 51 and a secondary winding 52, which are wound in the same direction. The winding 51, the capacitor 20, the flashtube 11 and the capacitor 19 form a circuit for firing the flashtube 11, when the capacitor 19 discharges. The winding 51, the capacitor 20 and the flashtube 12 form a circuit for firing the flashtube 12, when the capacitor 20 discharges.

The winding 52 is connected between ground and a terminal that is common to the diodes 46 and 47, which couple the winding 52 to the electrodes 13 and 14, respectively. The winding 52, the diode 46, the electrode 13 and the capacitor 19 form a circuit for triggering the flashtube 11. The winding 52, the diode 47, and the electrode 14 form a circuit for triggering the flashtube 12.

The transformer 45 is arranged to produce a flashtube trigger voltage across its secondary winding 52 in response to interrupting current through its primary winding 51.

The diodes 46 and 47 are arranged so that when the voltage across the winding 52 is positive with respect to ground, the diode 46 conducts to cause a voltage to be applied to the electrode 13, and when voltage across the winding 52 is negative with respect to ground, the diode 47 conducts to apply a voltage to the electrode 14.

The circuitry 48 includes a starter capacitor 53, a charging resistor 54, and a normally open switch 55 connected between ground and a terminal common to the capacitor 53 and the resistor 54. The DC—DC converter 17 of FIG. 3, in addition to being connected to the anode of the diode 18, is also connected to the cathode of a diode 56. The diode 56 conducts in response to the negative voltage pulses produced by the converter 17, to charge the capacitor 53 through the resistor 54 with a polarity as shown.

The capacitor 53 is arranged to supply a discharge current to the winding 51 to induce a voltage pulse across the winding 52 that can trigger the flashtube 11.

The switch 55 is arranged to close momentarily in response to opening a shutter (not shown) in an associated camera (also not shown) so that the capacitor 53 can discharge through the winding 51.

The circuitry 49 includes a normally open switch 60 connected in series to the anode of a diode 62. The series connection of the switch 60 and the diode 62 is parallel to the winding 51 such that the cathode of the diode is connected to the terminal common to the capacitor 20 and the winding 51. The diode 62 is arranged, as shown, to divert the firing current supplied by the capacitor 20 to the flashtube 12 so as to bypass the winding 51 while the switch 60 is closed.

The switch 60 can be a mechanism that is arranged to close in response to closing the camera shutter. The shutter can be mechanically controlled so that it closes after a predetermined time corresponding to a desired exposure interval. Alternatively, the shutter can be electronically controlled by a light-sensitive time-delay circuit which causes the shutter to close after the circuit senses a predetermined amount of light, corresponding to a desired exposure.

Alternatively the switch 60 can be in the form of an electronic switch which is caused to close in response to the occurrence of a predetermined exposure parameter. In this form, the switch 60 may include a transistor, or an SCR, which is caused to close when the aforementioned light-sensitive circuit senses a desired amount of light.

In operating the energy-saving electronic strobe flash apparatus 10 of FIG. 3, the capacitor 19 and the capacitor 53 are charged with voltages having polarities as shown. The switch 55 closes in response to opening the camera shutter. When the switch 55 is closed, the capacitor 53 discharges rapidly through the winding 51.

Since the winding 50 is wound in the same direction as the winding 49, the voltage induced across the winding 50 while the capacitor 53 is discharging is positive with respect to ground. This voltage forwardly biases the diode 46, which causes a voltage pulse to be applied to the electrode 13 to initially trigger the flashtube 11.

In response to triggering the flashtube 11, the capacitor 19 discharges through the flashtube 11, the capacitor 20, and the winding 51 to ground, thereby firing the flashtube and charging the capacitor 20. When the capacitor 20 is charged to a level relative to the charge on the capacitor 19 so that conduction of flashtube 11 can no longer be sustained, the flashtube firing current is interrupted, thereby quenching the flashtube 11.

In response to the interruption of this current through the winding 51, the magnetic field in the core 50 collapses. This collapsing field induces a voltage pulse across the winding 52 that is negative at the terminal common to the diodes 46 and 47. In response to this pulse, the diode 47 conducts, thereby triggering the flashtube 12.

In response to triggering the flashtube 12, the capacitor 20 discharges through the flashtube and the winding 51, thereby producing a light pulse. When the voltage across the capacitor 20 decreases below a level required to sustain conduction of the flashtube 12, the current from the capacitor 20 is interrupted, thereby quenching the flashtube 12.

Also, when this current is interrupted, the magnetic field in the core 50 collapses. In this case, as the field collapses, the voltage induced across the winding 52 is positive with respect to ground. In response to this voltage, the diode 46 is forwardly biased, to produce a voltage on the electrode 13 that triggers the flashtube 11. The firing and quenching of the flashtubes 11 and 12 oscillates back and forth thereafter, as described above.

After a given interval, which terminates with the occurrence of a predetermined exposure parameter, the switch 60 closes. After this occurs, when the flashtube 12 conducts, its firing current flows primarily through the switch 60 and the diode 62, instead of through the winding 51.

The energy stored in the core 50 during this firing of the flashtube 12 is much smaller than the energy stored during any preceding firing of the flashtube 12. Accordingly, when the magnetic field collapses in response to the interruption of current through the flashtube 12, only minimal voltage is induced across the winding 52. This voltage is insufficient to retrigger the flashtube 11.

The circuitry 49 is arranged to cause the flashtube 12 to produce the last pulse in the series of light pulses produced by the two flashtubes so that the capacitor 20 can be discharged. This ensures that when a subsequent light pulse is desired, the voltage potential across the flashtube 11, which is determined by the difference between the charge on the capacitors 19 and 20, is sufficient to initially fire the flashtube.

The invention has been described in detail with particular reference to preferred embodiments thereof, but it will be understood that variations and modifications can be effected within the spirit and scope of the invention.

What is claimed is:

1. In electronic flash apparatus comprising first and second flashtubes having first and second electrodes, respectively, for triggering their respective flashtubes into conduction to produce light pulses, first and second capacitors for supplying firing currents to said first and second flashtubes, respectively, for causing them to produce respective light pulses, means for charging said first capacitor, a first circuit comprising said first flashtube and said first and second capacitors, and having (1) a first state, occurring in response to triggering said first flashtube, for causing a first firing current to flow from said first capacitor through said first circuit to fire said first flashtube and to charge said second capacitor, and (2) a second state, occurring in response to charging said second capacitor to a predetermined voltage, for interrupting the first firing current, thereby quenching said first flashtube, and a second circuit comprising said second flashtube and said second capacitor, responsive to triggering said second flashtube, for causing a second firing current to flow from said second capacitor to fire said second flashtube, the improvement comprising:

(a) initiating means for applying an initial trigger voltage to said first electrode for triggering said first flashtube; and (b) current-sensitive means, coupling said first circuit to said second electrode, for triggering said second flashtube in response to the interruption of the first firing current, whereby said first and second flashtubes are fired sequentially to produce sequential light pulses.

2. In electronic flash apparatus comprising first and second flashtubes having first and second electrodes, respectively, for triggering their respective flashtubes into conduction to produce light pulses, first and second capacitors for supplying firing currents to said first and second flashtubes, respectively, for causing them to produce respective light pulses, and means for charging said first capacitor, the improvement comprising:

(a) transformer means having first and second windings, said second winding being adapted to produce a flashtube trigger voltage in response to interrupting current in said first winding;

(b) initiating means for applying an initial trigger voltage to said first electrode for triggering said first flashtube;

(c) a first circuit comprising said first flashtube, said first and second capacitors, and said first winding, and having (1) a first state, occurring in response to triggering said first flashtube, for causing a first firing current to flow from said first capacitor through said first circuit to fire said first flashtube, and to charge said second capacitor, and (2) a second state, occurring in response to charging said second capacitor to a predetermined level relative to the charge on said first capacitor, for interrupting the first firing current, thereby quenching said first flashtube and causing said second winding to produce a flashtube trigger voltage;

(d) means, coupling said second electrode to said second winding, for triggering said second flashtube in response to the flashtube trigger voltage; and (e) a second circuit comprising said second flashtube and said second capacitor, responsive to triggering said second flashtube, for causing a second firing current to flow from said second capacitor to fire said second flashtube, whereby said first and second flashtubes are fired sequentially to produce sequential light pulses.

3. In electronic flash apparatus comprising first and second flashtubes having first and second electrodes, respectively, for triggering their respective flashtubes into conduction to produce respective light pulses, first and second capacitors for supplying firing currents to said first and second flashtubes, respectively, for causing them to produce respective light pulses, and means for charging said first capacitor, the improvement comprising:

(a) transformer means comprising first and second windings, said second winding being adapted to produce a flashtube trigger voltage in response to interrupting current in said first winding;

(b) initiating circuitry, including a third capacitor chargeable by said capacitor charging means, said transformer means, and an actuatable switch having an actuated state for discharging said third capacitor through said first winding to produce a flashtube trigger voltage across said second winding;

(c) first switch means, coupling said first electrode to said second winding, responsive to the flashtube trigger voltage when said third capacitor is discharged, for applying a voltage to said first electrode to initially trigger said first flashtube;

(d) a first circuit comprising said first flashtube, said first and second capacitors, and said first winding, and having (1) a first condition, occurring in response to triggering said first flashtube, for causing a first firing current to flow from said first capacitor through said first circuit to fire said first flashtube, and to charge said second capacitor, and (2) a second condition, occurring in response to charging said second capacitor to a given level relative to the charge on said first capacitor, for interrupting the first firing current, thereby quenching said first flashtube and causing said second winding to produce a flashtube trigger voltage;

(e) second switch means, coupling said second electrode to said second winding, responsive to the flashtube trigger voltage when the first firing current is interrupted, for applying a voltage to said second electrode to trigger said second flashtube; and (f) a second circuit, including said second flashtube and said second capacitor, reponsive to triggering said second flashtube, for causing a second firing current to flow from said second capacitor to fire said second flashtube, whereby said first and second flashtubes are fired sequentially to produce sequential light pulses.

4. In electronic flash apparatus comprising first and second flashtubes having first and second electrodes, respectively, for triggering their respective flashtubes into conduction to produce light pulses, first and second capacitors for supplying firing currents to said first and second flashtubes, respectively, for causing them to produce respective light pulses, means for charging said first capacitor, a first circuit comprising said first flashtube connected between said first and second capacitors, and having (1) a first condition, occurring in response to triggering said first flashtube, for causing a first firing current to flow from said first capacitor through said first circuit to fire said first flashtube, and to charge said second capacitor, and (2) a second condition, occurring in response to charging said second capacitor to a first given voltage, for interrupting the first firing current, thereby quenching said first flashtube, and a second firing circuit comprising said second flashtube and said second capacitor, and having (1) a first condition, occurring in response to triggering said second flashtube, for causing a second firing current to flow from said second capacitor to fire said second flashtube, and (2) a second condition, occurring in response to discharging said second capacitor to a second given voltage, for interrupting the second firing current, thereby quenching said second flashtube, the improvement comprising:

(a) initiating means for applying an initial voltage to said first electrode for triggering said first flashtube;

(b) current-sensitive means, coupling said first and second circuits to said second and first electrodes, respectively, for triggering said second flashtube in response to the interruption of the first firing current and for triggering said first flashtube in response to the interruption of the second firing current, whereby said first and second flashtubes are fired sequentially to produce sequential light pulses; and (c) control means, responsive to the occurrence of a predetermined exposure parameter, for overriding said current-sensitive means to terminate the production of light pulses.

5. In electronic flash apparatus comprising first and second flashtubes having first and second electrodes, respectively, for triggering their respective flashtubes into conduction to produce respective light pulses, first and second capacitors for supplying firing contents to said first and second flashtubes, respectively, for causing them to produce light pulses, and means for charging said first capacitor, the improvement comprising:

(a) transformer means comprising first and second windings, said second winding being adapted to produce a flashtube trigger voltage in response to interrupting current in said first winding;

(b) initiating means for applying a flashtube trigger voltage to said first electrode to initially trigger said first flashtube;

(c) a first circuit comprising said first flashtube, said first and second capacitors, and said first winding, and having (1) a first condition, occuring in response to triggering said first flashtube, for causing a first firing current to flow from said first capacitor through said first flashtube, said second capacitor and said first winding to fire said first flashtube and to charge said second capacitor, and (2) a second condition, occurring in response to charging said second capacitor to a first given level relative to the charge on said first capacitor, for interrupting the first firing current to quench said first flashtube and to cause said second winding to produce a first flashtube trigger voltage;

(d) a second circuit comprising said second flashtube, said second firing capacitor, and said first winding, and having (1) a first condition, occurring in response to triggering said second flashtube, for causing a second firing current to flow from said second capacitor through said second flashtube and said first winding to fire said second flashtube, and (2) a second condition, occurring in response to discharging said second capacitor to a second given level, for interrupting the second firing current to quench said second flashtube and to cause said second winding to produce a second flashtube trigger voltage;

(e) switch means connecting said second winding to said first and second electrodes, and having (1) a first state, occurring in response to the first flashtube trigger voltage for applying a voltage to said second electrode to trigger said second flashtube, and (2) a second state, occurring in response to the second flashtube trigger voltage for applying a voltage to said first electrode to trigger said first flashtube, whereby said first and second flashtubes are fired alternately for producing alternate light pulses; and (f) control means, reponsive to the occurrence of a predetermined exposure parameter, for causing current to bypass said first winding to prevent the production of a flashtube trigger voltage, whereby the light pulses are terminated.

6. In electronic flash apparatus comprising first and second flashtubes having first and second electrodes, respectively, for triggering their respective flashtubes into conduction to produce respective light pulses, first and second capacitors for supplying firing currents to said first and second flashtubes, respectively, for causing them to produce respective light pulses, and means for charging said first capacitor, the improvement comprising:

(a) transformer means comprising first and second windings, said second winding being adapted to produce a flashtube trigger voltage in response to interrupting current in said first winding;

(b) initiating means for applying a trigger voltage to said first electrode to initially trigger said first flashtube;

(c) a first circuit comprising said first flashtube, said first and second capacitors, and said first winding, and having (1) a first condition, occurring in response to triggering said first flashtube, for causing a first firing current to flow from said first capacitor through said first flashtube, said second capacitor and said first winding, to fire said first flashtube, and to charge said second capacitor, and (2) a second condition, occurring in response to the first firing current charging said second capacitor to a first given level relative to the charge on said second capacitor, for interrupting the first firing current, thereby quenching said first flashtube and causing said second winding to produce a flashtube trigger voltage;

(d) a second circuit comprising said second flashtube, said second firing capacitor, and said first winding, and having (1) a first condition, occurring in response to triggering said second flashtube, for causing a second firing current to flow from said second capacitor through said second flashtube and said first winding, to fire said second flashtube, and (2) a second condition, occurring in response to the second firing current discharging said second capacitor to a second given level, for interrupting the second firing current, thereby quenching said second flashtube and causing said second winding to produce a flashtube trigger voltage;

(e) a first diode connecting said second winding to said first electrode, and a second diode connecting said second winding to said second electrode, said first and second diodes being arranged such that (1) said first diode conducts in response to the flashtube trigger voltage when the second firing current is interrupted to apply a voltage to said first electrode to trigger said first flashtube, and (2) said second diode conducts in response to the flashtube trigger voltage when the first firing current is interrupted to apply a voltage to said second electrode to trigger said second flashtube, whereby said first and second flashtubes are fired alternately into conduction for producing alternate light pulses repeatedly; and (f) control means, responsive to the occurrence of a predetermined exposure parameter, for causing the second firing current to bypass said first winding to prevent the production of a flashtube trigger voltage when the second firing current is interrupted whereby the light pulses are terminated.

* * * * *